US009915094B2

(12) United States Patent
Frede

(10) Patent No.: US 9,915,094 B2
(45) Date of Patent: Mar. 13, 2018

(54) ROLLER SHUTTER FOR OPENING AND CLOSING A DOORWAY

(71) Applicant: Assa Abloy Entrance Systems AB, Landskrona (SE)

(72) Inventor: Friedhelm Frede, Erwitte (DE)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 8 days.

(21) Appl. No.: 14/763,439

(22) PCT Filed: Jan. 14, 2014

(86) PCT No.: PCT/EP2014/050614

§ 371 (c)(1),
(2) Date: Jul. 24, 2015

(87) PCT Pub. No.: WO2014/114528

PCT Pub. Date: Jul. 31, 2014

(65) Prior Publication Data

US 2015/0361715 A1 Dec. 17, 2015

(30) Foreign Application Priority Data

Jan. 28, 2013 (SE) ..... 1350091

(51) Int. Cl.
*E06B 9/17* (2006.01)
*E06B 9/18* (2006.01)
(Continued)

(52) U.S. Cl.
CPC ..... *E06B 9/17* (2013.01); *E06B 9/18* (2013.01); *E06B 9/58* (2013.01); *E06B 9/60* (2013.01);
(Continued)

(58) Field of Classification Search
CPC ..... E06B 9/17; E06B 9/17061; E06B 9/18; E06B 9/58; E06B 9/60
See application file for complete search history.

(56) References Cited

U.S. PATENT DOCUMENTS 3,430,677 A * 3/1969 Pierce ..... E06B 9/13 160/264
3,900,063 A * 8/1975 Roller ..... E06B 9/17 160/310
(Continued)

FOREIGN PATENT DOCUMENTS

DE 2565285 A1 * 12/1958
DE 33 43 849 A 6/1985
(Continued)

OTHER PUBLICATIONS

International Type Search Report issued by Swedish Patent Office for priority Swedish application 1350091-3.

*Primary Examiner* — Blair M Johnson
(74) *Attorney, Agent, or Firm* — Wissing Miller LLP

(57) ABSTRACT

The invention relates to a roller shutter (10, 32, 42, 51) for opening and closing a doorway having a door leaf (11) and side rails (17) for guiding the door leaf (11), and having a coiling device (14) for selectively rolling up the door leaf (11) for opening the doorway and unrolling the door leaf (11) for closing the doorway. For reducing or avoiding the risk of creating a polygon effect and for providing a roller shutter (10, 32, 42, 51) comprising a door leaf having rigid shutter elements with an increased height and/or with the possibility of applying an increased speed for opening and/or closing the door leaf the roller shutter (10, 32, 42, 51) is characterized in that a separate guiding device (21, 33, 43) is provided for guiding the door leaf (11) in the area between the side rail (17) and the coiling device (14), wherein the guiding device
(Continued)

Figure 1:
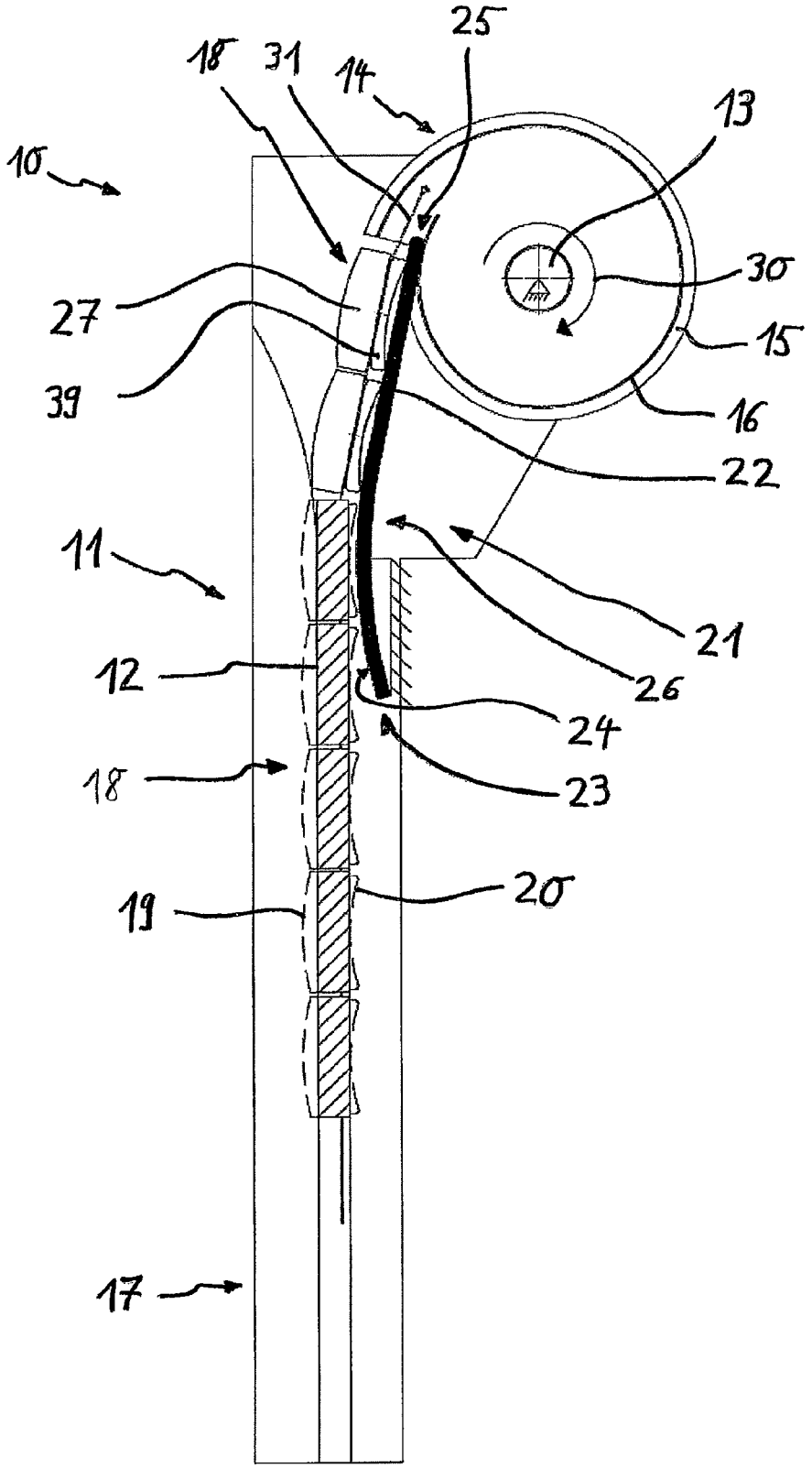

(21, 33, 43) is arranged to adjust to an increasing diameter and to a decreasing diameter of the coiling device (14).

13 Claims, 7 Drawing Sheets

(51) Int. Cl.
*E06B 9/58* (2006.01)
*E06B 9/60* (2006.01)
*E06B 9/174* (2006.01)

(52) U.S. Cl.
CPC ... *E06B 9/17061* (2013.01); *E06B 2009/1743* (2013.01)

(56) References Cited

U.S. PATENT DOCUMENTS 4,220,189 A * 9/1980 Marquez ..... E06B 9/17076 160/23.1
4,478,268 A * 10/1984 Palmer ..... B65G 69/008 160/272
5,819,831 A * 10/1998 Schanz ..... E06B 9/174 160/133
6,192,960 B1 * 2/2001 Simon ..... E06B 9/0653 160/266
7,516,770 B2 * 4/2009 Jerry ..... E06B 9/13 160/267.1
8,272,425 B2 * 9/2012 Coenraets ..... E06B 9/58 160/133
8,789,576 B2 * 7/2014 Krueger ..... A62C 2/10 160/133
2003/0034135 A1 2/2003 Simon
2010/0101739 A1 * 4/2010 Coenraets ..... E06B 9/58 160/267.1
2010/0218431 A1 9/2010 Hardison, III et al.
2011/0265959 A1 * 11/2011 Frede ..... E06B 9/17076 160/133
2015/0361715 A1 * 12/2015 Frede ..... E06B 9/17061 160/133

FOREIGN PATENT DOCUMENTS

EP 0 780 542 A 6/1997
EP 1 956 179 A 8/2008
EP 1 956 180 A 8/2008
WO WO 2008/016573 A 2/2008

* cited by examiner

ROLLER SHUTTER FOR OPENING AND CLOSING A DOORWAY

This application is a 371 of PCT/EP2014/050614 filed on Jan. 14, 2014, published on Jul. 31, 2014 under publication number WO 2014/114528, which claims priority benefits from Swedish Patent Application No. 1350091-3 filed Jan. 28, 2013, the disclosure of which is incorporated herein by reference.

The invention relates to a roller shutter for opening and closing a doorway having a door leaf and side rails for guiding the door leaf, and having a coiling device for selectively rolling up the door leaf for opening the doorway and unrolling the door leaf for closing the doorway. More particularly, the present invention provides a rollup door, preferably an industrial high speed rollup door, with a rollable door leaf comprised of lamellae or panels for covering a door opening.

Such a roller shutter or rollup door is known from the document US 2011/0265959 A1.

Roller shutters and rollup doors are used in industrial facilities, such as factories, warehouses, garages, and the like to cover doorways or to guard machinery in order to provide security, as well as protection from debris, and unwanted climatic variations.

A drawback of known roller shutters is that at higher speeds, particularly if the door leaf comprises rigid shutter elements, a polygon effect is created. This polygon effect leads to shaking and/or swinging of the door leaf, particularly the shutter elements, in an area between the coiling device and the side rails. This creates unwanted running noises and the risk of damage is increased. To avoid the polygon effect it is known to reduce the opening and/or closing speed for the door leaf. However, this has the disadvantage that high speed roller shutters or rollup doors are limited in regard to the opening and/or closing speed. Furthermore, the size of the door leaf or shutter elements and/or the operating life is limited.

If rigid shutter elements, particularly lamellae or panels, are used the risk of creating the polygon effect may be reduced by using lamellae or panels with a reduced height. However, a disadvantage of this solution is that the actual need is directed to use of rigid shutter elements, like lamellae or panels, with an increased height and/or thickness. An increased height and/or thickness of the lamellae is needed to optimize the thermal insulation of the door leaf as energy saving becomes more and more important. Furthermore, manufacturing costs can be reduced if rigid shutter elements with an increased height and/or thickness can be used.

It is therefore a principal object of the present invention to enhance a roller shutter as mentioned in the preceding introduction such that the risk of creating a polygon effect is reduced or avoided. It is a further object of the present invention to provide a roller shutter comprising a door leaf having rigid shutter elements with an increased height and/or with the possibility of applying an increased speed for opening and/or closing the door leaf.

The object of the invention is accomplished by a roller shutter as mentioned in the preceding introduction, which provides a separate guiding device for guiding the door leaf in the area between the side rail and the coiling device, wherein the guiding device is arranged to adjust to an increasing diameter and/or radius of the coiling device as the door leaf is rolled up on the coiling device and to a decreasing diameter of the coiling device as the door leaf is unrolled from the coiling device.

It is advantageous here that the door leaf is, preferably in the plane of the doorway, guided by the guiding device between the side rail and the coiling device. By this additional guiding device the creation of a polygon effect is effectively prevented. The guiding device is designed to prevent the door leaf, particularly the rigid shutter elements, from shaking, swinging and/or creating noise. Since the guiding device is arranged to adjust to an increasing diameter and decreasing diameter of the coiling device, the door leaf, particularly the rigid shutter elements, are guided between the said rail and the coiling device during the whole process of up rolling and/or unrolling the door leaf. Thereby, the effect of the guiding device is maintained during the whole process of rolling up and/or unrolling the door leaf. Thus, the creation of a polygon effect is effectively prevented during the whole process. The door leaf, particularly the rigid shutter elements, is prevented from shaking, swinging and/or creating noise during the whole process of rolling up and/or unrolling the door leaf. Therefore, rigid shutter elements with an increased height can be used and/or the running speed for opening and/or closing the doorway can be increased.

According to a further embodiment of the present invention each side rail is fitted with a guiding device. Advantageously, the roller shutter with the rollable door leaf includes a rail frame having the side rails. Preferably two side rails are provided which are arranged on two sides of the door leaf turned away from each other. In particular there is provided a first side rail on a first side of the doorway and/or rail frame and a second side rail on second side of the doorway and/or rail frame. Particularly the side rails extend in the vertical direction in regard to their longitudinal axis. The door leaf, particularly the shutter elements, is adapted to travel within the side rails.

A further embodiment of the present invention provides a first end of the guiding device that is assigned to the side rail and a second end which is turned away from the first end and that second end is assigned to the coiling device. The first end and the second end of the guiding device are arranged for providing a guidance for the transition of the door leaf from the side rail to the coiling device and vice versa. Preferably the first end and/or the second end of the guiding device merge with the side rail and/or coiling device respectively for generating a continuous guidance for the door leaf, particularly the shutter elements. Preferably the first end and/or the second end of the guiding device comprises a part or element for avoiding or reducing wear. Such a part or element may be a roll, a rotatable cylinder or a low-friction gliding face.

According to a further embodiment of the present invention the guiding device comprises an elongated guiding track for guiding and supporting the door leaf. The elongated guiding track may be linear or curved. Preferably the guiding track elongates or extends the side rail guiding to the coiling device, particularly the rollup radius of the coiling device. The rollup radius and the diameter or radius of the coiling device may depend on the position of the door leaf. When the doorway is fully closed the door leaf is fully unrolled and the coiling device provides the smallest rollup radius and/or diameter. When the doorway is fully opened the door leaf is fully up rolled on the coiling device and the coiling device with the up rolled door leaf provides the maximum rollup radius and/or diameter.

Preferably the door leaf comprises several rigid shutter elements. The shutter elements may be designed as lamellae or panels. The shutter elements may be elongated and/or oriented substantially in a horizontal direction. Advantageously, edges of adjacent shutter elements are configured to at least partially engage in a pivoting fashion. The shutter elements may have window-like openings extending there through, by way of example for ventilation or visibility. The openings may be covered in one or both sides with transparent or translucent materials to limit ventilation and/or visibility. The shutter elements may be fabricated from substantially rigid materials such as metal, plastic and/or wood.

The shutter elements, particularly the lamellae or panels, may comprise end pieces. Preferably each shutter element has two end pieces which are fitted to the shutter element at two ends of the shutter element. The two ends of the shutter element with the end pieces are directed away from each other. The end piece may be provided for gliding within the side rail and for being guided by the guiding device. As, in particular at high speed roller shutters, the shutter elements of different layers rolled up on the coiling device should not touch each other directly the end pieces provide a distance between the rolled up shutter elements. Only the end pieces are rolled up onto each other when the door leaf is at least partly rolled up. Preferably the end pieces have an inner concave and/or an outer convex contour or cross section. Thus, a concave surface is facing inward and/or towards the coiling device, particularly a rotatable shaft of the coiling device. The convex surface is facing outward and/or away from the coiling device, particularly a rotatable shaft of the coiling device. The end pieces may have a substantially flattened arcuate C-shape cross section. Preferably the cross section of the end pieces is selected such that when the door leaf is rolled up a compacted configuration is provided. Each end piece for one of the two side rails may have an individual selected cross section.

Preferably each end piece comprises a spacer and/or a coiling rest. The coiling rest may comprise the inner concave surface. The spacer is arranged on a surface of the coiling rest turned away from the inner concave surface. The thickness of the spacer and/or the coiling rest may define the distance between two adjacent layers of up rolled shutter elements, particularly lamellae or panels. The outer surface of the spacer turned away from the coiling rest may provide the convex surface. Particularly a carrying strap is clamped between the spacer and the coiling rest. One end of the carrying strap is connected to the coiling device. Therefore, the door leaf may be rolled up by rotating the coiling device such that the carrying strap is coiled round the coiling device. Together with the carrying strap the end pieces and the shutter elements are rolled up round the coiling device. Preferably the shutter elements are secured to the carrying strap by the end pieces and the position of one shutter element to another is determined by the carrying strap. Particularly no mechanical linkage between adjacent shutter elements is necessary, thus each shutter element supports only its own weight. In a further embodiment at least parts of adjacent shutter elements are configured to pivotally engage.

Advantageously, each spacer comprises at least one, preferably two, spacer bars. These spacer bars may provide a contact face for arranging end pieces onto each other in an at least partial up rolled position of the door leaf. Thus, in an up rolled position the end pieces of an outer layer of up rolled end pieces are deposited or arranged on the spacer bars of an adjacent inner layer of up rolled end pieces. Preferably the contact face of the spacer bars is the convex surface of the spacer. Particularly the spacer bars extend to the directly adjacent preceding and/or subsequent end piece for bridging a gap between directly adjacent end pieces. When the end pieces are rolled up round the coiling device a gap between two consecutive end pieces at their outer circumference arises. Thus, a deposition track build of the rolled up end pieces, particularly the spacer bars, would be interrupted and a next layer of up rolled end pieces cannot be supported in the area of the gap. According to an embodiment of the invention the spacer bars extend to a surface of an preceding and/or subsequent end piece such that the spacer bars of the two consecutive end pieces superpose with each other when the end pieces are rolled up. Therefore, the rolled up end pieces provide a continuous deposition track for the arrangement of a subsequent layer of end pieces. The two spacer bars of each end piece may be directed parallel to each other. In a different embodiment the two spacers of each end piece may be oriented to each other in a funnel shaped form or they may taper conically towards each other.

According to a further embodiment of the present invention the guiding track has an abutment face for contacting the door leaf, particularly the end pieces of the shutter elements. The end pieces, particularly the coiling rest of the end pieces, may slide on the abutment face of the guiding track. Preferably the abutment face is directed towards the inner side of the door leaf. Furthermore, the guiding device may comprise a counter track with a surface which is directed towards the abutment face. Thus, the door leaf, particularly the end pieces, may be guided between the abutment face of the guiding track and the surface of the counter track avoiding any shaking or swinging in the area between the side rail and the coiling device in a direction across the longitudinal alignment of the guiding device and/or door leaf. Preferably the spacer bars of each end piece provide a channel for guiding track and/or counter track. The two spacer bars of each end piece may be spaced apart such that the guiding track and/or counter track may be aligned between the spacer bars.

Preferably a first end of the guiding device is assigned to a funnel of the side rail. A funnel or a funnel shaped upper inlet permits an easy and effective entering and/or exiting of the door leaf or end pieces in and/or out the side rail, particularly in case of a varying angle between the side rail, the door leaf and/or the guiding device caused by a fixed axis of the coiling device. Preferably an inner side of the funnel merge with the abutment face of the guiding track. Thus, the door leaf, particularly the end pieces, may slide on a continuous track from the guiding track of the guiding device into the side rail and vice versa.

Advantageously, the second end of the guiding track is aligned tangentially or at least substantially or almost tangentially to a sliding guide of the coiling device and/or to a slide face of an up rolled end piece. The second end of the guiding track is assigned to the coiling device and/or up rolled end pieces. The second end of the guiding track may be in contact with the sliding guide of the coiling device and/or the slide face of an up rolled end piece such that the second end substantially does not protrude over the circumference of the coiling device with and/or without up rolled end pieces. This may avoid the appearance of a displacement and/or step joint at the transition of the guiding track to the coiling device, particularly the sliding guide or slide face.

Preferably the coiling device comprises a rotatable shaft with at least one spiral disc at each end of the shaft. The spiral disc may provide a continuous increasing radius. Preferably the outer circumference of the coiling device is defined by the outer circumference of the spiral disc and/or the outer face of end pieces up rolled on the spiral disc.

Particularly a first layer of end pieces is rollable on the outer circumferential surface of the spiral disc and/or on the outer contact face of at least one layer of an at least partly up rolled door leaf. The outer circumference of the spiral disc and/or the outermost circumference of at least one layer of an at least partly up rolled door leaf, particularly the circumference of up rolled end pieces, may comprise a deposition track for the arrangement of the door leaf, particularly of the end pieces of the shutter elements, on the deposition track.

Preferably the second end of the guiding track is aligned tangentially or at least substantially or almost tangentially to the sliding guide of the coiling device, particularly the guiding track merge with the sliding guide. In an unrolled position of the door leaf the second end of the guiding track may be aligned at least substantially tangentially to the sliding guide of the coiling device, preferably the abutment face of the guiding track merge with the sliding guide. In an at least partly up rolled position of the door leaf the second end of the guiding track may be aligned at least tangentially to the slide face of an outer layer of end pieces rolled up on the spiral disc. In this case the abutment face of the guiding track may merge with the slide face of the outer layer of end pieces. The sliding guide may be arranged between to spiral discs or on an outer face of a single spiral disc.

According to a further embodiment of the present invention the position of the guiding track is adjustable to a change of the diameter or radius of the coiling device for ensuring a tangential or at least substantially or almost tangential transition of the guiding track, preferably the second end of the guiding track, to the sliding guide and/or to the slide face of an up rolled end piece. The diameter or radius of the coiling device depends on the amount of layers of up rolled door leaf, particularly end pieces. In case of an unrolled door leaf the diameter or radius is smallest and is particularly defined by the diameter or radius of the spiral disc. In case of an at least partly up rolled door leaf the diameter or radius depends on the layers of door leaf, particularly end pieces, around the spiral disc. The greatest diameter or radius is reached when the door leaf is fully up rolled.

Preferably the guiding track is flexible for adapting to a changing diameter or radius of the coiling device, preferably of the sliding guide of the spiral disc and/or of the slide face of up rolled end pieces. Providing a flexible guiding track is a cost-effective way to realize an adjustable guiding track. Preferably the flexible guiding track is elastic such that it will move back self-acting to its initial position.

The guiding track may comprise a flexible area and/or a joint located adjacent to the side rail. Preferably the guiding track bends around the flexible area or joint depending on the diameter or radius of the coiling device, preferably of the sliding guide of the spiral disc and/or of the slide face of up rolled end pieces. Thus, not the whole guiding track needs to be flexible. It is sufficient to provide a guiding track with a defined twistable region.

According to a further embodiment of the present invention the guiding device comprises a compensation mechanism and/or a rotation mechanism for aligning the second end of the guiding track tangentially or at least substantially or almost tangentially to the sliding guide of the coiling device and/or to a slide face of an up rolled end piece, preferably for adjusting the position of the second end of the guiding track depending on the diameter or radius of the coiling device, preferably of the sliding guide of the spiral disc and/or of the slide face of up rolled end pieces. If the guiding track is flexible the tangential contact point of the guiding track with the sliding guide or slide face may change depending on the diameter or radius of the coiling device. This may lead to a protruding second end of the guiding track over the circumference of the coiling device. By the compensation mechanism and/or the rotation mechanism the second end of the guiding track may be continuously adjusted such that the second end of the guiding track always merge with the circumference of the coiling device, particularly the sliding guide and/or slide face.

Preferably the compensation mechanism and/or rotation mechanism comprises a pivotable support structure having the guiding track and the support structure is pivotable mounted around a bearing. The support structure may be made of rigid material like metal and/or plastic. Preferably the bearing is provided by a holding device extending from the upper end of the side rail in a direction away from the door leaf. The support structure and the holding device may be made of the same material. The bearing may be located at one end of the holding device which is spaced apart from the upper end of the side rail and from the first end of the guiding track. Preferably the distance between the upper end of the side rail and the bearing is at least ¼ of the smallest radius of the spiral disc. Preferably the distance is at least ½ or ¾ of the smallest radius of the spiral disc. Advantageously, the distance is as small as possible to avoid the transmittance of great forces.

According to a further embodiment of the present invention the guiding device is in a fixed position and the rotatable shaft of the coiling device is moveable in a direction across, particularly rectangular, to the plane of the doorway and the rotatable shaft is moveable depending on the diameter or radius of the coiling device, preferably of the outer circumference of the spiral disc and/or of the contact face of up rolled end pieces, for aligning the second end of the guiding track tangentially or at least substantially or almost tangentially to the sliding guide and/or to the slide face of up rolled end pieces. The greater the diameter or radius of the coiling device is the greater the distance between the rotatable shaft and the side rail and/or the doorway is. Preferably the second end of the rigid guiding track always merges with the circumference of the coiling device, particularly of the sliding guide of the spiral disc and/or of the slide face of up rolled end pieces.

Figure 2:
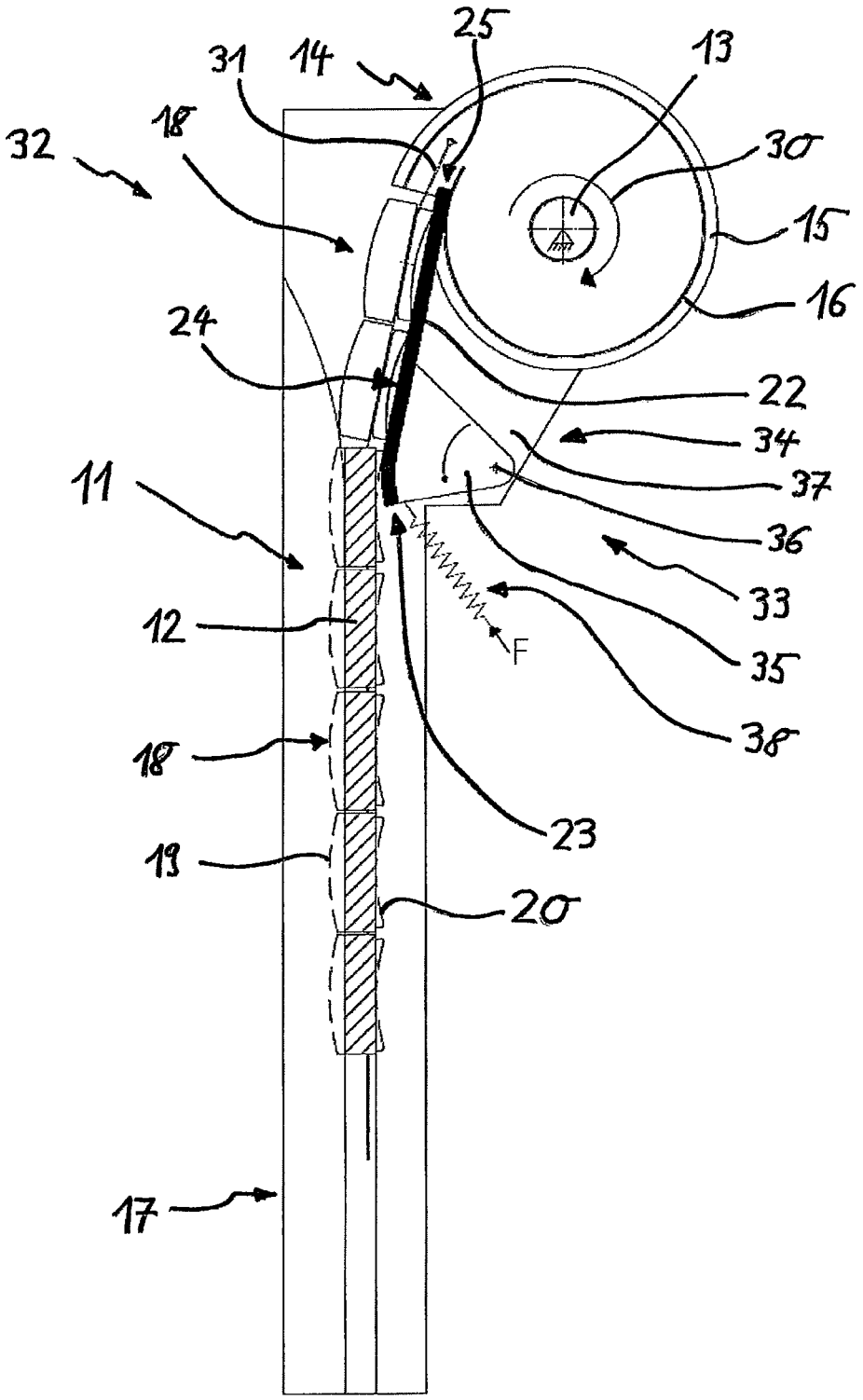
Figure 3:
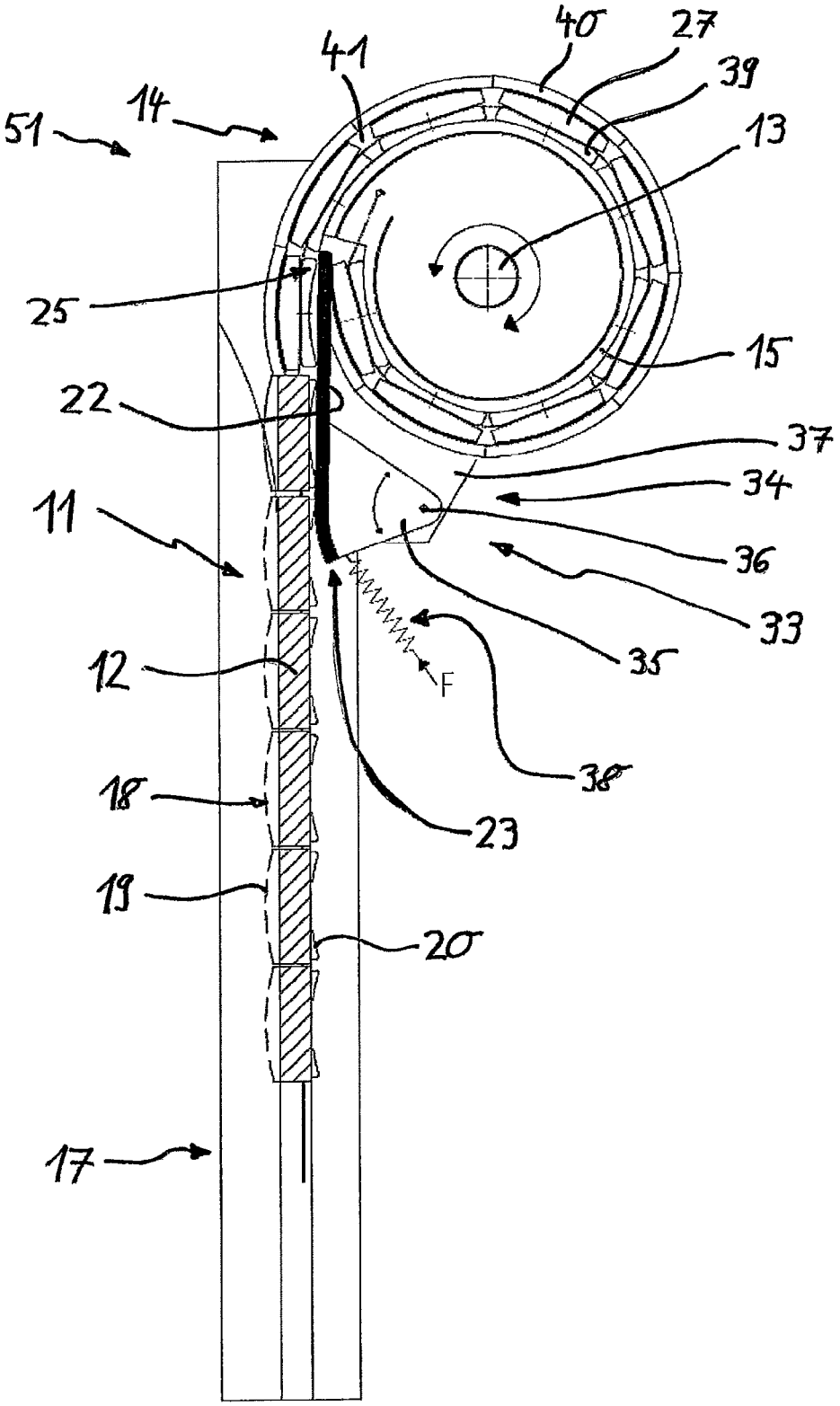
Figure 4:
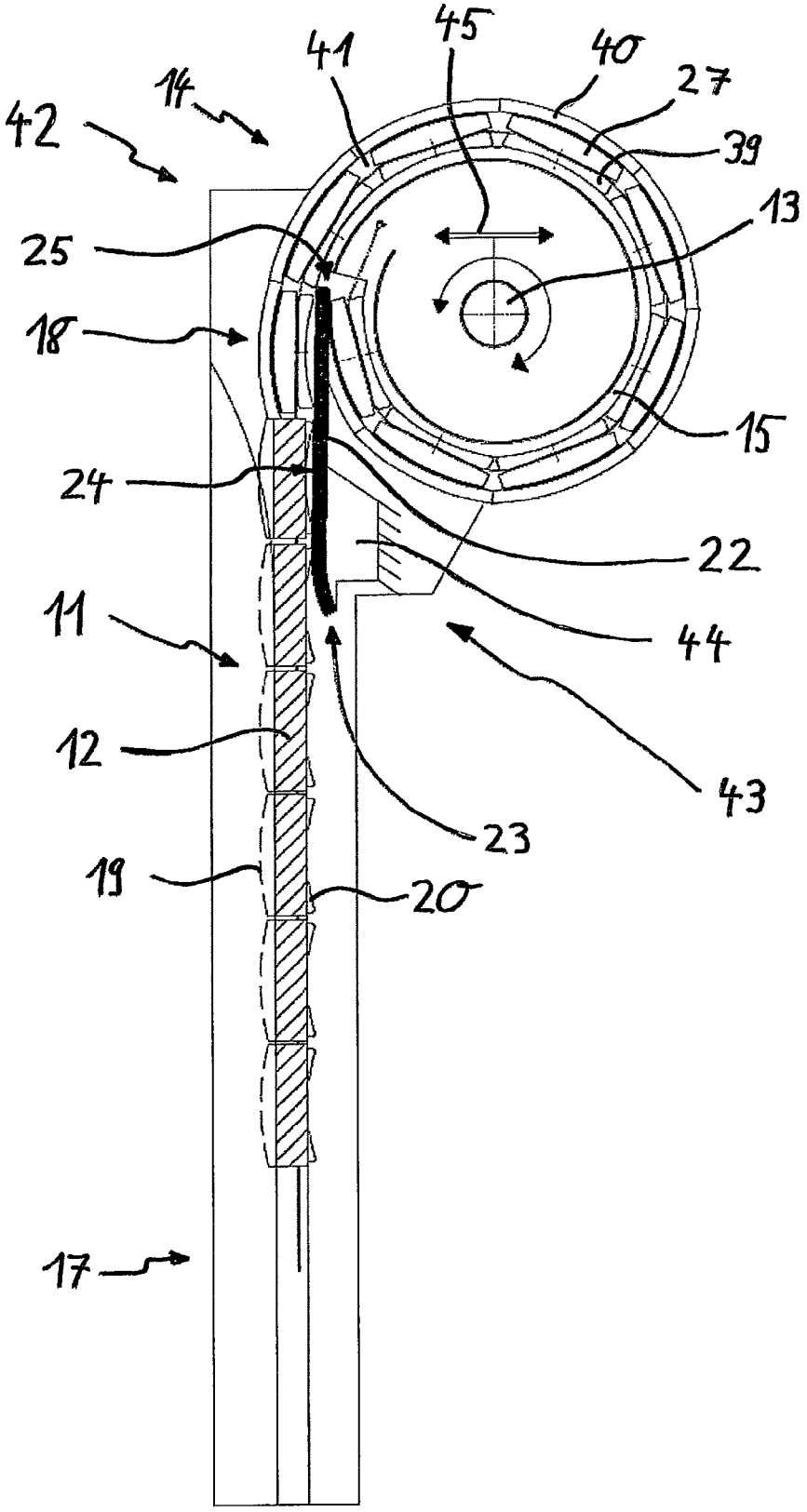
Figure 5:
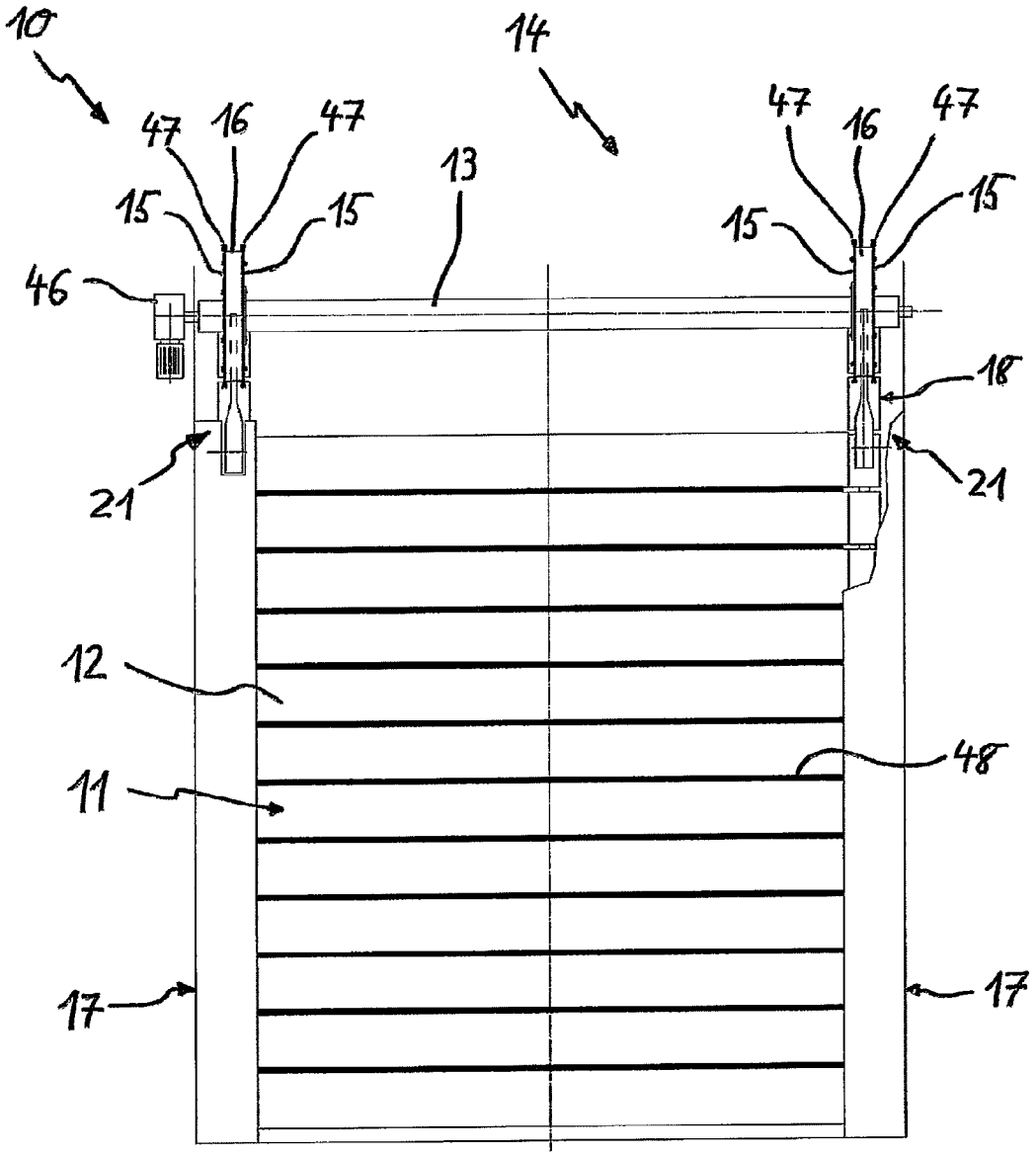
Figure 6:
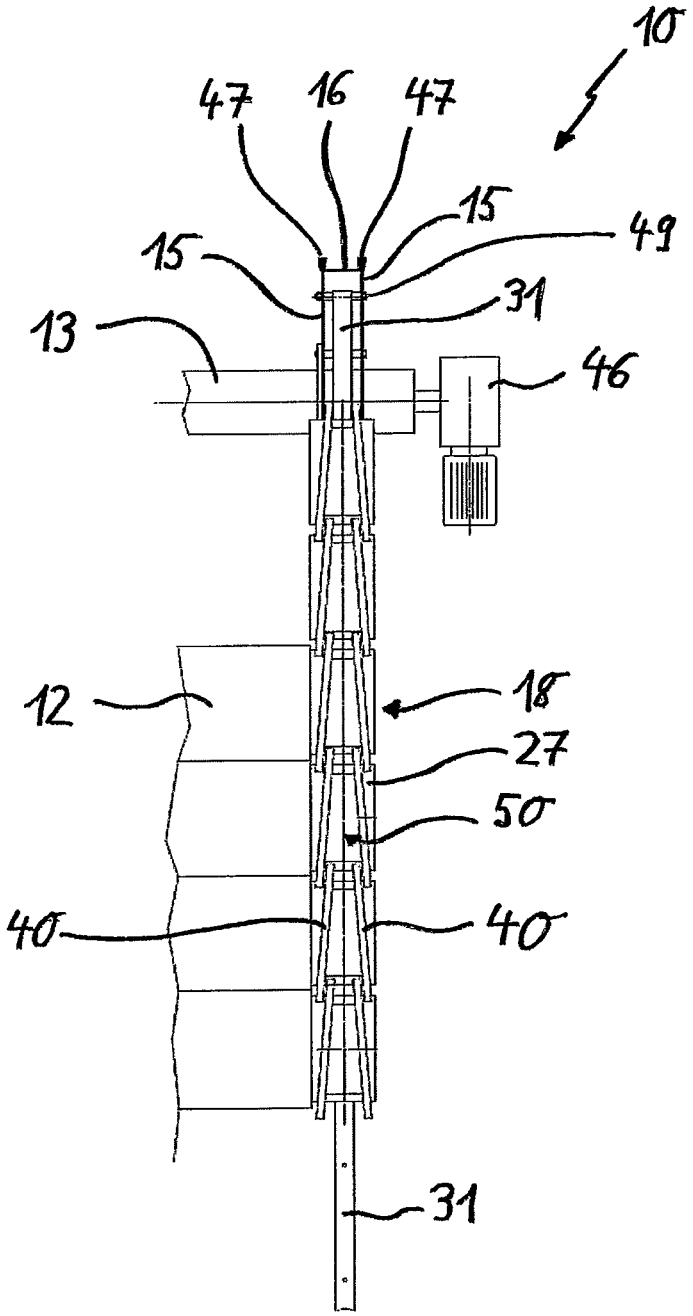
Figure 7:
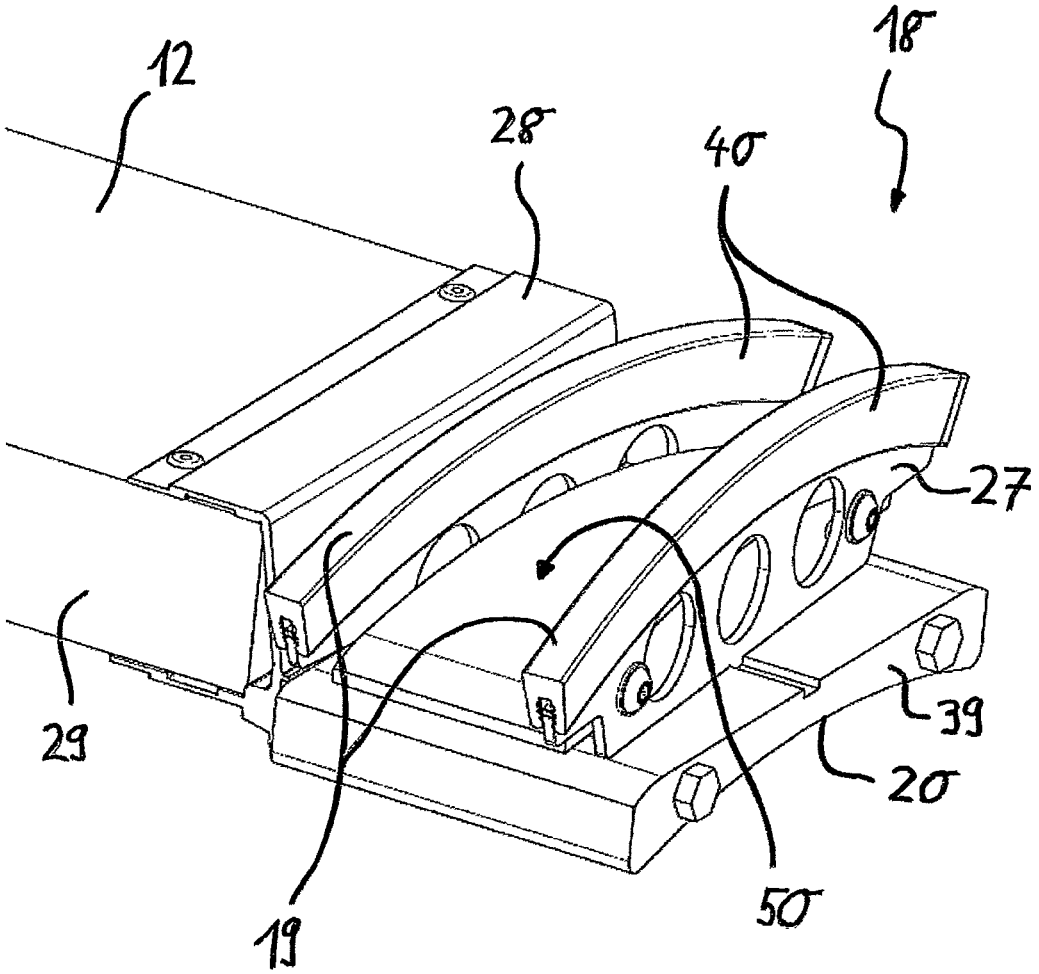

The following detailed description, given by way of example and not intended to limit the present invention solely thereto, will best be appreciated in conjunction with the accompanying figures, wherein like reference numerals denote like elements and parts, in which:

FIG. 1 is a schematic cross sectional side view of a first rollup door according to the present invention with an unrolled door leaf, FIG. 2 is a schematic cross sectional side view of a second rollup door according to the present invention with an unrolled door leaf, FIG. 3 is a schematic cross sectional side view of a third rollup door according to the present invention with a partly up rolled door leaf, FIG. 4 is a schematic cross sectional side view of a further rollup door according to the present invention with a partly up rolled door leaf, FIG. 5 is a front view of the rollup door according to FIG. 1, FIG. 6 is a schematic front view of one side of the rollup door according to FIG. 5 without a side rail, and FIG. 7 is a perspective view of an end piece for a rollup door according to the present invention.

The present invention will now be described more fully hereinafter with reference to the accompanying figures in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The roller shutter will be described as a rollup door selectively blocking or opening a doorway. This recitation is for convenience only. It would be understood by one skilled in the art that such a roller shutter or rollup door is suitable for many embodiments and/or applications, including, but not limited to industrial high speed rollup doors, interior doorway covering, exterior doorway covering, etc.

A first embodiment of the rollup door according to the present invention is described with reference to FIG. 1, in which a schematic cross sectional side view of a first rollup door 10 according to the present invention with an unrolled door leaf 11 is shown. The door leaf 11 comprises several shutter elements 12. For a greater clarity only one shutter element 12 provides a reference numeral and not all shutter elements 12 are shown. Further shutter elements 12 may be arranged at the lower end of the door leaf 11. In this embodiment the shutter elements 12 are rigid lamellae 12. The lamellae 12 are at least partly rotatable coupled to each other allowing up and unrolling of the lamellae 12 around a rotatable shaft 13. A drive system (not shown) provides a rotational force or torque to the shaft 13 in one direction as indicated by arrow 30 to raise the door leaf 11 and in a second direction opposite to the direction of arrow 30 to lower the door leaf 11. As shown in FIG. 1 the door leaf 11 is fully unrolled.

The rotatable shaft 13 is part of a coiling device 14. According to this embodiment the coiling device 14 comprises four spiral discs 15. A pair of two spiral discs 15 is fixed to each end of the rotatable shaft 13. According to this figure only one spiral disc 15 is shown. The spiral discs 15 have a continuously increasing radius such that the outer circumference of the spiral discs 15 comprises a mismatch. The smallest radius transitions smoothly to the greatest radius over a rotation of approximately 360 degrees. Furthermore, the two spiral discs 15 of each pair are arranged as mirror images of each other and are connected to each other by a sliding guide 16. Furthermore, the sliding guide 16 is arranged in spiral shape along the outer circumference of the spiral discs 15. The sliding guide 16 is inwardly spaced in regard to the outer circumference of the spiral discs 15. Thus, the radius of the sliding guide 16 is smaller than the corresponding radius of the spiral discs 15. The distance between the sliding guide 16 and the outer circumference of the spiral discs 15 is kept constant.

The rollup door 10 further comprises two side rails 17. In this figure only one side rail 17 at one side of the doorway is shown. The side rails 17 are elongated in a vertical direction and are designed to receive and guide end pieces 18 of the lamellae 12. The side rails 17, provided on either side of the doorway, define the width of the passable doorway and are configured to accept the end pieces 18 within a slot. Each lamella 12 provides two end pieces 18, one end piece 18 at each lamella end. The end pieces 18 comprise an outer convex face 19 and an inner concave face 20. Each end piece 18 comprises a spacer 27 and a coiling rest 39. The spacer 27 has the outer convex face 19 and the coiling rest 39 has the inner concave face 20. In this embodiment the upper two end pieces 18 are not connected with a lamella 12 as this part bridges the gap between the side rail 17 and the coiling device 14 above the doorway.

According to this embodiment the greatest radius of the spiral discs 15 exceeds the smallest radius of the spiral discs 15 by a dimension approximately equal to the thickness of the end piece 18.

The rollup door 10 provides a guiding device 21 arranged between the side rail 17 and the coiling device 14. According to this embodiment the guiding device 21 is configured as an elongated guiding track 22 which may be arcuated or curved. A first end 23 of the guiding track 22 is coupled to the upper inlet of the side rail 17. The guiding track 22 has an abutment face 24 which is directed towards the inner side of door leaf 11, particularly towards the concave face 20 of end pieces 18. In the region of the first end 23 the abutment face 23 may merge with the inner side of the side rail 17. A second end 25 of the guiding track 22 directed away from the first end 23 is assigned to the coiling device 14. In this embodiment the outermost area or edge of the second end 25 rests substantially tangentially on the outer surface of the sliding guide 16 between the spiral discs 15 or on a slide face (not shown) of an up rolled end piece 18. The second end 25 is arranged in a height which is located substantially in the height of the shaft 13.

A carrying strap 31 is affixed with one end to the coiling device 14. In this embodiment the carrying strap 31 is mounted at the spiral discs 15. The carrying strap 31 is connected with the end pieces 18 to roll up and roll down the lamellae 12. One carrying strap 31 is provided on each side of the doorway in conjunction with the end pieces 18. In one rotating direction of the coiling device 14 the carrying strap 31 with end pieces 18 will be hoisted and rolled up, causing the lamellae 12 to be wound up around the coiling device 14, opening the doorway. In second rotating direction of the coiling device 14 turned away from the first direction the carrying strap 31 with the end pieces 18 will unwind from its rolled up position, releasing the lamellae 12 to cover the doorway.

In the exemplary embodiment the guiding track 22 is configured as a flexible and elastic strip. In more detail the guiding track 22 is almost rigid expect a flexible area 26.

Here the flexible area is located approximately one-third up the first end 23 of the elongated guiding track 22. The part with the first end 23 under the flexible area 26 is fixedly mounted to the rollup door 10. The part above the flexible area 26 with the second end 25 may be bend round a virtual axis provided by the flexible area 26. The virtual axis provided by the flexible area 26 is directed almost parallel to the plane of the door leaf 11 or the axis of the shaft 13. In the position shown in FIG. 1 the part of the guiding track 22 above the flexible area 26 is bent slightly out of the vertical direction and towards the rotatable shaft 13 and the sliding guide 16.

In the position of the door leaf 11 with a partly up rolled door leaf 11, particularly with a first layer of up rolled end pieces 18, the part of the guiding track 22 above the flexible area 26 and with the second end 25 is bent round the virtual axis provided by the flexible area 26 such that the guiding track 22 would be aligned in a substantially vertical direction. In case of more successive layers of end pieces 18 the part above the flexible area 26 with the second end 25 would be bent in a direction away from shaft 13.

FIG. 2 shows a schematic cross sectional side view of a second rollup door 32 according to the present invention with an unrolled door leaf 11. As far as identical elements are concerned reference is made to the above mentioned description.

The rollup door 32 provides a guiding device 33 arranged between the side rail 17 and the coiling device 14. According to this embodiment the guiding device 21 is configured as an elongated and substantially linear guiding track 22. However, in an alternative embodiment the guiding track 22 may be arcuated or curved. The first end 23 of the guiding track 22 is dedicated to the upper inlet of the side rail 17. The second end 25 of the guiding track 22 directed away from the first end 23 is assigned to the coiling device 14. In this embodiment the outermost area or edge of the second end 25 rests substantially tangentially on the outer surface of the sliding guide 16 provided by the outer circumference of the coiling device 14 or on a slide face (not shown) of an up rolled end piece 18.

The guiding device 33 has a rotation mechanism 34 for adjusting the position of the second end 25 of the guiding track 22 depending on the diameter or radius of the coiling device 14 with and without up rolled end pieces 18. For this purpose the rotation mechanism 34 provides a pivotable support structure 35. The guiding track 22 is attached to the support structure 35. In this embodiment less than half of the guiding track 22 adjacent to the first end 23 is affixed to the support structure 35. Furthermore, the support structure 35 is pivotable mounted around a bearing 36. The bearing is spaced apart from the first end 23 of the guiding track 22 and located in a direction away from the side trail 17. The support structure 35 is held by a holding device 37 via the bearing 36. In this embodiment the holding device 37 is a side wall which is connected with side rail 17.

Adjacent to the first end 23 of the guiding track 22 a pressure element 38 is connected with the pivotable support structure 35. The pressure element 38 provides a force directed to the support structure 35 as indicated by arrow F such that the support structure 35 is pushed around the bearing 36 to place the outermost area or edge of the second end 25 of the guiding track 22 on the outer surface of the sliding guide 16 or a slide face (not shown) of an up rolled end piece 18. The pressure element 38 may be a pressure spring or a pressure piston.

FIG. 3 shows a schematic cross sectional side view of a third rollup door 51 according to the present invention with a partly up rolled door leaf 11. The configuration and function of rollup door 51 is similar to the rollup door 32 as shown in FIG. 2. As far as identical elements are concerned reference is made to the above mentioned description.

In the position of the door leaf 11 as shown in FIG. 3 with a partly up rolled door leaf 11, particularly with a first layer of up rolled end pieces 18, the guiding track 22 is pivoted round the bearing 36 such that substantially the whole guiding track 22, preferably the abutment face 24 contacting the end pieces 18 in the area of the concave face 20 of the coiling rest 39, is aligned in a substantially vertical direction. In case of more successive layers of end pieces 18 the guiding track 22 would be pivoted around the bearing 36 in a direction away from shaft 13.

The outer face of each end piece 18 or spacer 27 comprises a convex face 19. In an up rolled position the convex face 19 serves as a contact face on which subsequent end pieces 18, namely the concave face 20, can rest. In this embodiment each spacer 27 comprises two spacer bars 40. The end pieces 18 of all embodiments as disclosed by the figures of this application may comprise such spacer bars 40. In this cross sectional side view only one spacer bar 40 can be seen. The outer faces of the spacer bars 40 form the convex face 19 of the end pieces 18. The outer face of the spacer 27 between the spacer bars 40 forms the slide face (not shown) for the second end 25 of the guiding track 22. When the end pieces 18 are rolled up round the shaft 13 and a first layer of end pieces 18, namely the concave face 20, is aligned on the outer circumference of the spiral discs 15 the slide faces of the up rolled end pieces 18 form a continuation of the sliding guide 16 as well as the convex surface 19 of the spacer bars 40 form a continuation of the spiral outer circumference of the spiral discs 15.

In FIG. 3 one layer of end pieces 18 on the spiral discs 15 is shown. In this configuration the first layer of end pieces 18 on the spiral discs 15 follows a smooth curve as preset by the outer circumference of the spiral discs 15. Each successive layer of end pieces 18 lies smoothly atop the convex contacting face 19 of spacers 27 as a part of the continued outer spiral circumference of the preceding layer of end pieces 18. The end pieces 18 have a substantially flattened arcuated "C" shape in cross section. The end pieces 18 cross section is chosen to substantially correspond to the outer circumference of the spiral discs 15 and of the layers of up rolled end pieces 18 respectively. This allows successive layers of end pieces 18 wound onto the spiral disc 15 and onto preceding layers of end pieces 18 to present a smooth wound outer surface and a compact rolled up door leaf 11. In this regard a geometric relationship has to be considered which combines the height of the door opening, the configuration of the spiral discs 15 and the height as well as the cross section of the end pieces 18. Each layer of rolled up end pieces 18 creates a greater diameter or radius of the coiling device 14 for successive layers to wind up onto, resulting in deviating cross sections, convex faces 19 and concave faces 20 for each end piece 18 in a row. Preferably a fully wound up door will require two, three or more 360 degrees turns of the shaft 13 depending on the height of the door leaf and/or doorway.

The outermost area or edge of the second end 25 of the guiding track 22 rest substantially tangentially on the slide face adjacent to the spacer bars 40 of the spacer 27 of the end pieces 18 rolled up as a first layer round the spiral discs 15. The convex slide face of the rolled up end pieces 18 forms a continued sliding guide 16 for the guiding track 22.

Each spacer bar 40 has a thickness which is at least slightly thicker than the thickness of the guiding track 22. The guiding track 22 is positioned between two spacer bars 40 which are aligned in a longitudinal direction adjacent to each other. The distance between two adjacent spacer bars 40 is at least slightly greater than the width of the guiding track 22. Thus, the guiding track 22 is guided within each pair of spacer bars 40 of each end piece 18.

The spacer bars 40 of each end piece 18 extend over the spacer 27 to the spacer 27 of a preceding and following end piece 18. Thus, the spacer bars 40 of two adjacent end pieces 18 overlap, thereby bridging a gap 41 between adjacent or two end pieces 18 in a row.

FIG. 4 shows a schematic cross sectional side view of a further rollup door 42 according to the present invention with a partly up rolled door leaf 11. As far as identical elements are concerned reference is made to the above mentioned description.

The rollup door 42 provides a guiding device 44 arranged between the side rail 17 and the coiling device 14. According to this embodiment the guiding device 44 has an elongated and substantially linear guiding track 22. However, in an alternative embodiment the guiding track 22 may be arcuated or curved. The first end 23 of the guiding track 22 is dedicated to the upper inlet of the side rail 17. The second end 25 of the guiding track 22 directed away from the first end 23 is assigned to the coiling device 14. In this embodiment the outermost area or edge of the second end 25 rests substantially tangentially on the outer surface of the sliding guide 16 provided by the outer circumference of the coiling device 14 or a slide face (not shown) of an up rolled end piece 18.

In this embodiment the guiding track 22 is rigid and mounted to a fixed base 44 which is part of the guiding device 43. Thus, the guiding device 43 is in a fixed position and the guiding track 22 cannot change its position. To allow an adjustment in regard to a changing diameter or radius of the coiling device 14 dependent of the amount of up rolled layers of lamellae 12 or end pieces 18 the shaft 13 is moveable seated. As indicated by arrow 45 the shaft 13 is moveable in a direction perpendicular to the plane of the doorway or the longitudinal direction of the side rails 17.

FIG. 5 shows a front view of the rollup door 10 according to FIG. 1. However, the following description of this embodiment is also valid for rollup doors 32, 42, 51. Thus, the guiding device 10 may be interchanged with one of the guiding devices 33 or 43. The line of sight is directed to the inner side of the door leaf 11.

One end of the shaft 13 is connected to a drive system 46. The drive system 46 provides a rotational force or torque to the shaft 13 to raise or lower the door leaf 11.

Each spiral disc 15 comprises a damping profile 47 on its outer circumference leading to a reduction of noise when end pieces 18 are rolled on or rolled up the spiral discs 15. In this embodiment the damping profiles 47 are made of rubber leading to an anti-slip function which avoids movements of up rolled end pieces 18. Furthermore, the wear of the concave face 20 of the end piece 18 is reduced.

Between two pivotable connected lamellae 12 a sealing 48 is provided avoiding the entry of moisture and/or dirt into the connection. The sealing 48 is flexible and in this embodiment the sealing 48 is made of an elastomer, preferably EPDM (Ethylene Eropylene Diene Monomer).

FIG. 6 is a schematic front view of one side of the rollup door 10 according to FIG. 5 without a side rail 17. It is shown that the upper end of carrying strap 31 is fixed between the pair of spiral discs 15 by a pin 49. The pin 49 is aligned parallel to the axis of shaft 13.

Each end piece 18 has a pair of spacer bars 40 on the outer surface of the spacer 27. Between the spacer bars 40 of each end piece 18 a slide face 50 for contacting the second end 25 of the guiding track 22 is provided. The spacer bars 40 of directly adjacent end pieces 18 are overlapping and extend to the outer surface of the directly adjacent end piece 18 or spacer 27. In this embodiment the spacer bars 40 of each pair are inclined to each other. In an alternative embodiment the spacer bars 40 of each pair may be aligned parallel and/or shifted to each other.

FIG. 7 shows a perspective view of an end piece 18 for a rollup door 10, 32, 42, 51 according to the present invention. The width of the coiling rest 39 is slightly larger than the width of the spacer 27. In this embodiment the spacer 27 is fixed to the coiling rest 39 on a side turned away from the concave face 20 of the coiling rest 39. The coiling rest 39 is fixed to an end cap 28. The end cap 28 is substantially U-shaped and fixed to an end of the lamella 12. The lamella 12 comprises in this embodiment a foamed core 29. The slide face 50 or outer surface of the spacer 27 has a similar convex shape as the convex face 19 of the spacer bars 40. In this embodiment the convex face 19 of the spacer bars 40 comprise a damping material similar to the damping profiles 47 of the spiral discs 15 to reduce noise and/or wear when end pieces 18 are rolled onto or rolled up from each other.

Although preferred embodiments of the present invention and modifications thereof have been described in detail herein, it is to be understood that this invention is not limited to these precise embodiments and variations and may be effected by one skilled in the art without departing from the spirit and scope of the invention as defined by the appended claims.

| Reference Numerals: | |
|---|---|
| 10 | rollup door |
| 11 | door leaf |
| 12 | shutter element |
| 13 | rotatable shaft |
| 14 | coiling device |
| 15 | spiral disc |
| 16 | sliding guide |
| 17 | side rail |
| 18 | end piece |
| 19 | convex (outer) face |
| 20 | concave (inner) face |
| 21 | guiding device |
| 22 | guiding track |
| 23 | first end |
| 24 | abutment face |
| 25 | second end |
| 26 | flexible area |
| 27 | spacer |
| 28 | end cap |
| 29 | foamed core |
| 30 | arrow |
| 31 | carrying strap |
| 32 | rollup door |
| 33 | guiding device |
| 34 | rotation mechanism |
| 35 | support structure |
| 36 | bearing |
| 37 | holding device |
| 38 | pressure element |
| 39 | coiling rest |
| 40 | spacer bar |
| 41 | gap |
| 42 | rollup door |
| 43 | guiding device |
| 44 | base |
| 45 | arrow |
| 46 | drive system |
| 47 | damping profile |
| 48 | sealing |
| 49 | pin |
| 50 | slide face |
| 51 | rollup door |

The invention claimed is:

1. A roller shutter for opening and closing a doorway, the roller shutter comprising:

a door leaf;

side rails for guiding the door leaf;

a coiling device for selectively rolling up the door leaf for opening the doorway and unrolling the door leaf for closing the doorway; and a separate guiding device for guiding the door leaf in the area between the side rail and the coiling device;

wherein the guiding device is arranged, between the side rail and the coiling device, adjacent an inner side of the door leaf facing the coiling device, to adjust to an increasing diameter of the coiling device as the door leaf is rolled up on the coiling device and to a decreasing diameter of the coiling device as the door leaf is unrolled from the coiling device, wherein a first end of the guiding device is configured to engage the side rail and a second end of the guiding device, which is turned away from the first end, is configured to engage the coiling device;

wherein the door leaf comprises several rigid shutter elements;

wherein the shutter elements comprise end pieces which are provided for gliding within the side rail and for being guided by the guiding device;

wherein the guiding device comprises an elongated guiding track for guiding and supporting the door leaf; and wherein the guiding track has an abutment face for contacting the door leaf, and the abutment face is directed towards the inner side of the door leaf.

2. The roller shutter as claimed by claim 1;

wherein each side rail is fitted with one guiding device;

wherein one side rail is arranged on each side of the door leaf; and side rails extend in the vertical direction in regard to their longitudinal axis.

3. The roller shutter as claimed by claim 1;

wherein the guiding track is linear or curved.

4. The roller shutter as claimed by claim 1;

wherein the shutter elements are designed as lamellae or panels;

wherein the guiding track rests on the outer surface of a sliding guide or on a slide face of an up rolled end piece;

wherein each end piece comprises a spacer and a coiling rest; and wherein a carrying strap is clamped between the spacer and the coiling rest.

5. The roller shutter as claimed by claim 4;

wherein each end piece and/or spacer comprises at least one spacer bar for providing a contact face for arranging end pieces onto each other in an at least partial up rolled position of the door leaf; and wherein the spacer bars extend to the directly adjacent end pieces for bridging a gap between directly adjacent end pieces.

6. The roller shutter as claimed by claim 1;

wherein the abutment face is arranged for contacting the end pieces of the shutter elements; and wherein the guiding device further comprises a counter track with a surface directed towards the abutment face for contacting the end pieces in the area between the said rail and the coiling device.

7. The roller shutter as claimed by claim 1;

wherein a first end of the guiding device is configured to engage a funnel arranged on one of the side rails; and wherein an inner side of the funnel merges with the abutment face of the guiding track.

8. The roller shutter as claimed by claim 3, wherein an end of the guiding track is aligned tangentially to a sliding guide of the coiling device or to a slide face of an up rolled end piece;

wherein the coiling device comprises a rotatable shaft with at least one spiral disc at each end of the shaft; and wherein a first layer of the end pieces is rollable onto the outer circumferential surface of the spiral disc or onto an outer contact face of at least one layer of the at least partly up rolled door leaf.

9. The roller shutter as claimed by claim 3, wherein the position of the guiding track is adjustable to a change of the diameter of the coiling device for ensuring a tangential transition of an end of the guiding track to a sliding guide and/or slide face of an up rolled end piece.

10. The roller shutter as claimed by claim 3;

wherein the guiding track is flexible for adapting to a changing radius of the coiling device, of a sliding guide of a spiral disc, or of the slide face of up rolled end pieces; and/or wherein the guiding track comprises a flexible area or joint located adjacent to the side rail, the guiding track bending around the flexible area depending on the radius of the coiling device, the sliding guide of the spiral disc or of the slide face of up rolled end pieces.

11. The roller shutter as claimed by claim 3;

wherein the guiding device comprises a rotation mechanism for aligning an end of the guiding track tangentially to a sliding guide of the coiling device or to a slide face of an up rolled end piece, and for adjusting the position of the end of the guiding track depending on the radius of the coiling device, the sliding guide of a spiral disc, or the slide face of up rolled end pieces.

12. The roller shutter as claimed by claim 11;

wherein the rotation mechanism comprises a pivotable support structure having the guiding track, the support structure pivotally mounted around a bearing, the bearing being provided by a holding device extending from an upper end of the side rail in a direction away from the door leaf; and wherein the bearing is located at one end of the holding device which is spaced apart from the upper end of the side rail and from the first end of the guiding track.

13. A roller shutter for opening and closing a doorway, the roller shutter comprising:

a door leaf;

side rails for guiding the door leaf;

a coiling device for selectively rolling up the door leaf for opening the doorway and unrolling the door leaf for closing the doorway; and a separate guiding device for guiding the door leaf in the area between the side rail and the coiling device;

wherein the guiding device is arranged between the side rail and the coiling device adjacent an inner side of the door leaf facing the coiling device, wherein a first end of the guiding device is configured to engage the side rail and a second end of the guiding device, which is turned away from the first end, is configured to engage the coiling device;

wherein the door leaf comprises several rigid shutter elements;

wherein the shutter elements comprise end pieces which are provided for gliding within the side rail and for being guided by the guiding device;

wherein the guiding device comprises an elongated guiding track for guiding and supporting the door leaf;

wherein the guiding track is linear or curved; and wherein the guiding track has an abutment face for contacting the door leaf, and the abutment face is directed towards the inner side of the door leaf wherein the guiding device is in a fixed position and a rotatable shaft of the coiling device is moveable in a direction perpendicular to the plane of the doorway to adjust to an increasing diameter of the coiling device as the door leaf is rolled up on the coiling device and to a decreasing diameter of the coiling device as the door leaf is unrolled from the coiling device; and wherein the rotatable shaft moved, depending on the radius of the coiling device, the outer circumference of a spiral disc, or the contact face of up rolled end pieces, for aligning an end of the guiding track tangentially to the sliding guide or to the slide face of up rolled end pieces.

* * * * *